US012768053B2

(12) United States Patent
Moloney

(10) Patent No.: US 12,768,053 B2
(45) Date of Patent: Oct. 20, 2026

(54) ACID BASED CORROSION INHIBITOR COMPOSITIONS AND METHODS

(71) Applicant: ChampionX USA Inc., Sugar Land, TX (US)

(72) Inventor: Jeremy Moloney, Katy, TX (US)

(73) Assignee: ChampionX LLC, Sugar Land, TX (US)

( * ) Notice: Subject to any disclaimer, the term of this patent is extended or adjusted under 35 U.S.C. 154(b) by 1030 days.

(21) Appl. No.: 17/974,374

(22) Filed: Oct. 26, 2022

(65) Prior Publication Data

US 2023/0127419 A1 Apr. 27, 2023

Related U.S. Application Data

(60) Provisional application No. 63/272,443, filed on Oct. 27, 2021.

(51) Int. Cl.
*C23F 11/16* (2006.01)

(52) U.S. Cl.
CPC ..... *C23F 11/16* (2013.01)

(58) Field of Classification Search
None
See application file for complete search history.

(56) References Cited

U.S. PATENT DOCUMENTS

| | | | |
|---|---|---|---|
| 5,085,842 | A | 2/1992 | Porz et al. |
| 9,238,588 | B2 | 1/2016 | Harrington et al. |
| 9,394,396 | B2 | 7/2016 | Stark et al. |
| 9,605,195 | B2 | 3/2017 | Kakadjian et al. |
| 10,006,128 | B2 | 6/2018 | Webber et al. |
| 10,174,596 | B2 | 1/2019 | Hatchman et al. |
| 10,196,556 | B2 | 2/2019 | Hatchman et al. |
| 10,457,817 | B2 | 10/2019 | Ekoue-Kovi et al. |
| 10,604,710 | B2 | 3/2020 | Moloney |
| 10,806,147 | B2 | 10/2020 | Jones et al. |
| 10,899,980 | B2 | 1/2021 | Bartels et al. |
| 10,900,128 | B2 | 1/2021 | Geissler et al. |
| 2018/0112124 | A1 | 4/2018 | Conner et al. |
| 2018/0127638 | A1 | 5/2018 | Thompson-Colón et al. |
| 2018/0148632 | A1 | 5/2018 | Bennett et al. |
| 2018/0155609 | A1 | 6/2018 | Laurent et al. |
| 2019/0040301 | A1 | 2/2019 | Moloney et al. |
| 2020/0239338 | A1 | 7/2020 | Moloney et al. |
| 2020/0332423 | A1 | 10/2020 | Dhawan et al. |
| 2021/0095183 | A1 | 4/2021 | Li et al. |
| 2021/0102044 | A1 | 4/2021 | Zong et al. |

FOREIGN PATENT DOCUMENTS

| | | | |
|---|---|---|---|
| CN | 1324960 | A | 12/2001 |

OTHER PUBLICATIONS

Bilkova, K. & Hackerman, N. & Bartos, Milan. (2004). Inhibition Effect of Thioglycolic Acid on Carbon Dioxide Corrosion of Carbon Steel. Corrosion. 60. 10.5006/1.3287831.

Roberson et al., "Controlling Sessile Bacteria and Corrosion Using Biocide Slug Treatments and Oxygen Scavenger in a Sidestream Apparatus Associated With a Large Seawater Waterflood System," UK Corrosion 1984—Proceedings of the Conference, Nov. 12, 1984, pp. 147-156, vol. 1 (Papers).

Abdel-Akher M.: "Mercaptolysis of Dialdehyde Starch and Related Compounds with Mercaptoacetic Acid", Starch/Starke, vol. 39, No. 3, Jan. 1, 1987 (Jan. 1, 1987), pp. 98-103.

International Search Report and Written Opinion for International Application No. PCT/US2022/047918, mailed Feb. 17, 2023, 14 pages.

Ritter John J. et al: "Mercaptocarboxylic Acids as Reagents for the Identification of Carbonyl Compounds", Journal of the American Chemical Society, vol. 74, No. 22, Nov. 1, 1952 (Nov. 1, 1952), pp. 5576-5577.

*Primary Examiner* — Tanisha Diggs
(74) *Attorney, Agent, or Firm* — Eric D. Babych; Barnes & Thornburg LLP

(57) ABSTRACT

Compositions and methods for inhibiting corrosion of metal surfaces are disclosed herein. Also disclosed are methods of manufacturing the corrosion inhibitors compositions. The corrosion inhibitor compositions include the reaction product of a dicarbonyl compound with thioglycolic acid. The compositions may include other components, such as a solvent, a hydrogen sulfide scavenger, or a biocide.

8 Claims, No Drawings

ACID BASED CORROSION INHIBITOR COMPOSITIONS AND METHODS

TECHNICAL FIELD

The present disclosure generally relates to methods and compositions useful for inhibiting corrosion of metal surfaces.

BACKGROUND

Aqueous liquids are injected into the earth and/or recovered from the earth during subterranean hydrocarbon recovery processes, such as hydraulic fracturing (fracking) and tertiary oil recovery. In some processes, an aqueous liquid called an "injectate" is injected into a subterranean formation and a water source called "produced water" is recovered, i.e., flows back from the subterranean formation and is collected along with a hydrocarbon product. The injectate and the produced water may include one or more corrodents, such as salts and/or other dissolved solids, liquids, or gases that cause, accelerate, or promote corrosion of metal surfaces and/or containments, such as metal pipelines and metal tanks.

Corrosion inhibitors are typically employed to reduce corrosion of metal surfaces that are contacted by liquids containing corrodents. Corrosion inhibitors are added to the liquids and dissolved gasses that come into contact with the metal surfaces and they act to prevent, retard, delay, reverse, and/or otherwise inhibit corrosion of the metal surfaces.

Sulfur-based compounds are known to be highly effective corrosion inhibitors and are favored because they are inexpensive. However, some sulfur-based corrosion inhibitors are known to produce hydrogen sulfide gas when stored in an enclosed space.

Hydrogen sulfide is a known corrodent recognized to cause severe corrosion issues. Hydrogen sulfide is toxic and dissolves in both hydrocarbon (oil/gasoline) and water streams. Further, hydrogen sulfide is a flammable gas, providing a severe health and safety risk.

BRIEF SUMMARY

The present disclosure provides compositions and methods for inhibiting corrosion of metal surfaces. In some embodiments, the disclosure provides a composition comprising a reaction product of thioglycolic acid (TGA) and a dicarbonyl compound. The reaction product comprises a structure selected from Formula I

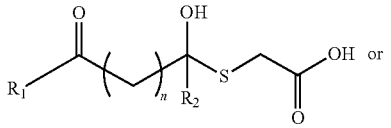

Formula II

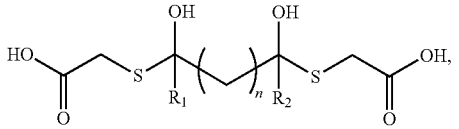

wherein $R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 50.

In some embodiments, the dicarbonyl compound comprises the following structure:

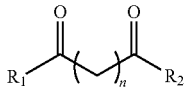

wherein n is an integer selected from 0 to about 50, and wherein $R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group. In some embodiments, the dicarbonyl compound is selected from glutaraldehyde, glyoxal, or a combination thereof.

In some embodiments, the dicarbonyl compound comprises the following structure:

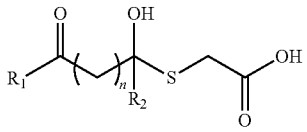

wherein n is an integer selected from 0 to about 50, and wherein $R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group.

In some embodiments, the composition further comprises a solvent. The solvent may be selected from the group consisting of water, a $C_1$-$C_6$ alkanol, a $C_1$-$C_6$ alkoxyalkanol, an alcohol, a glycol ether, a hydrocarbon, a ketone, an ether, an alkylene glycol, an amide, a nitrile, a sulfoxide, an ester, and any combination thereof.

In certain embodiments, the reaction product comprises a structure selected from

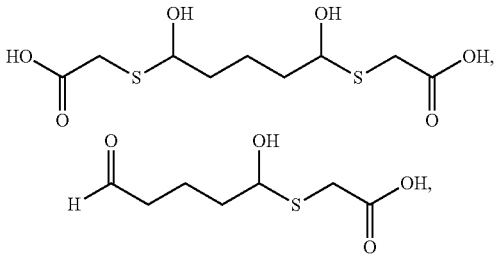

or a combination thereof.

In some embodiments, the composition is a liquid, a gel, or a mixture thereof.

In some embodiments, the composition comprises a pH from about 1 to about 11.

In certain embodiments, the composition comprises from about 0.5 wt. % to about 100 wt. % of the reaction product.

The present disclosure also provides methods of inhibiting corrosion of metal surfaces. In some embodiments, a method of inhibiting corrosion of a metal surface in contact with a medium comprises adding an effective amount of a composition to the medium, wherein the composition comprises a reaction product of TGA and a dicarbonyl compound, wherein the reaction product comprises a structure selected from Formula I

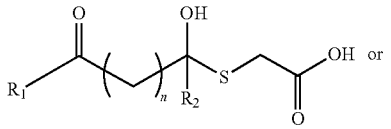

Formula II

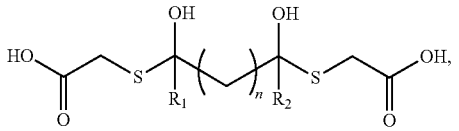

wherein $R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 50.

The effective amount may be from about 1 ppm to about 50,000 ppm.

In some embodiments, the medium comprises a corrodent selected from the group consisting of hydrogen sulfide, carbon dioxide, oxygen, sodium chloride, calcium chloride, sulfur dioxide, and any combination thereof.

In some embodiments, the medium comprises produced water, fresh water, recycled water, salt water, surface water, or any mixture thereof.

In certain embodiments, the metal surface comprises carbon steel.

The methods may further comprise adding to the medium a component selected from the group consisting of a fouling control agent, an additional corrosion inhibitor, a biocide, a preservative, an acid, a hydrogen sulfide scavenger, a surfactant, an asphaltene inhibitor, a paraffin inhibitor, a scale inhibitor, a gas hydrate inhibitor, a pH modifier, an emulsion breaker, a reverse emulsion breaker, a coagulant/flocculant agent, an emulsifier, a water clarifier, a dispersant, an antioxidant, a polymer degradation prevention agent, a permeability modifier, a foaming agent, an antifoaming agent, a $CO_2$ scavenger, an $O_2$ scavenger, a gelling agent, a lubricant, a friction reducing agent, a salt, and any combination thereof.

The additional corrosion inhibitor may comprise an imidazoline compound, a pyridinium compound, a quaternary ammonium compound, a phosphate ester, an amine, an amide, a carboxylic acid, a thiol, and any combination thereof.

The fouling control agent may comprise a quaternary compound.

The biocide may be selected from the group consisting of chlorine, hypochlorite, $ClO_2$, bromine, ozone, hydrogen peroxide, peracetic acid, peroxycarboxylic acid, peroxycarboxylic acid composition, peroxysulphate, glutaraldehyde, dibromonitrilopropionamide, isothiazolone, terbutylazine, polymeric biguanide, methylene bisthiocyanate, tetrakis hydroxymethyl phosphonium sulphate, and any combination thereof.

The acid may comprise hydrochloric acid, hydrofluoric acid, citric acid, formic acid, acetic acid, or any combination thereof.

The hydrogen sulfide scavenger may comprise an oxidant, inorganic peroxide, chlorine dioxide, a $C_1$-$C_{10}$ aldehyde, formaldehyde, glyoxal, glutaraldehyde, acrolein, methacrolein, a triazine, or any combination thereof.

The surfactant may be non-ionic, cationic, anionic, amphoteric, or zwitterionic.

In some embodiments, the composition comprises from about 0.1 wt. % to about 20 wt. % of the component.

In some embodiments, the medium comprises from about 1 ppm to about 1,000 ppm of the reaction product.

In certain embodiments, the component is added to the medium before, after, and/or simultaneously with the composition.

The present disclosure also provides methods of preparing the compositions and reaction products disclosed herein. In some embodiments, a method of preparing the reaction product comprises reacting the TGA with the dicarbonyl compound in a ratio of about 6:1 to about 0.5:1.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

DETAILED DESCRIPTION

The present disclosure provides compositions and methods for inhibiting corrosion of metal surfaces. The disclosure also provides methods of manufacturing the corrosion inhibitor compositions.

Unless otherwise indicated, an alkyl group as described herein—alone or as part of another group—is an optionally substituted linear or branched saturated monovalent hydrocarbon substituent containing from, for example, one to about sixty carbon atoms, such as one to about thirty carbon atoms, in the main chain. Examples of unsubstituted alkyl groups include methyl, ethyl, n-propyl, i-propyl, n-butyl, i-butyl, s-butyl, t-butyl, n-pentyl, i-pentyl, s-pentyl, t-pentyl, and the like.

The terms "aryl" or "ar" as used herein alone or as part of another group (e.g., arylene) denote optionally substituted homocyclic aromatic groups, such as monocyclic or bicyclic groups containing from about 6 to about 12 carbons in the ring portion, such as phenyl, biphenyl, naphthyl, substituted phenyl, substituted biphenyl or substituted naphthyl. The term "aryl" also includes heteroaryl functional groups. It is understood that the term "aryl" applies to cyclic substituents that are planar and comprise 4n+2n electrons, according to Huckel's Rule.

"Cycloalkyl" refers to a cyclic alkyl substituent containing from, for example, about 3 to about 8 carbon atoms, preferably from about 4 to about 7 carbon atoms, and more preferably from about 4 to about 6 carbon atoms. Examples of such substituents include cyclopropyl, cyclobutyl, cyclopentyl, cyclohexyl, cycloheptyl, cyclooctyl, and the like. The cyclic alkyl groups may be unsubstituted or further substituted with alkyl groups, such as methyl groups, ethyl groups, and the like.

"Halogen" or "halo" refers to F, Cl, Br, and I.

"Heteroaryl" refers to a monocyclic or bicyclic 5- or 6-membered ring system, wherein the heteroaryl group is unsaturated and satisfies Huckel's rule. Non-limiting examples of heteroaryl groups include furanyl, thiophenyl, pyrrolyl, pyrazolyl, imidazolyl, 1,2,3-triazolyl, 1,2,4-triazolyl, isoxazolyl, oxazolyl, isothiazolyl, thiazolyl, 1,3,4-oxadiazol-2-yl, 1,2,4-oxadiazol-2-yl, 5-methyl-1,3,4-oxadiazole, 3-methyl-1,2,4-oxadiazole, pyridinyl, pyrimidinyl, pyrazinyl, triazinyl, benzofuranyl, benzothiophenyl, indolyl, quinolinyl, isoquinolinyl, benzimidazolyl, benzoxazolinyl, benzothiazolinyl, quinazolinyl, and the like.

"Oxo" refers to an oxygen atom double-bonded to a carbon atom.

Compounds of the present disclosure may be substituted with suitable substituents. The term "suitable substituent," as used herein, is intended to mean a chemically acceptable functional group, preferably a moiety that does not negate the activity of the compounds. Such suitable substituents include, but are not limited to, halo groups, perfluoroalkyl groups, perfluoro-alkoxy groups, alkyl groups, alkenyl groups, alkynyl groups, hydroxy groups, oxo groups, mercapto groups, alkylthio groups, alkoxy groups, aryl or heteroaryl groups, aryloxy or heteroaryloxy groups, aralkyl or heteroaralkyl groups, aralkoxy or heteroaralkoxy groups, HO—(C═O)— groups, heterocylic groups, cycloalkyl groups, amino groups, alkyl- and dialkylamino groups, carbamoyl groups, alkylcarbonyl groups, alkoxycarbonyl groups, alkylaminocarbonyl groups, dialkylamino carbonyl groups, arylcarbonyl groups, aryloxy-carbonyl groups, alkylsulfonyl groups, and arylsulfonyl groups. In some embodiments, suitable substituents may include halogen, an unsubstituted $C_1$-$C_{12}$ alkyl group, an unsubstituted $C_4$-$C_6$ aryl group, or an unsubstituted $C_1$-$C_{10}$ alkoxy group. Those skilled in the art will appreciate that many substituents can be substituted by additional substituents.

The term "substituted" as in "substituted alkyl," means that in the group in question (i.e., the alkyl group), at least one hydrogen atom bound to a carbon atom is replaced with one or more substituent groups, such as hydroxy (—OH), alkylthio, phosphino, amido (—CON($R_A$)($R_B$), wherein $R_A$ and $R_B$ are independently hydrogen, alkyl, or aryl), amino (—N($R_A$)($R_B$), wherein $R_A$ and $R_B$ are independently hydrogen, alkyl, or aryl), halo (fluoro, chloro, bromo, or iodo), silyl, nitro (—$NO_2$), an ether (—O$R_A$ wherein $R_A$ is alkyl or aryl), an ester (—OC(O)$R_A$ wherein $R_A$ is alkyl or aryl), keto (—C(O)$R_A$ wherein $R_A$ is alkyl or aryl), heterocyclo, and the like.

When the term "substituted" introduces a list of possible substituted groups, it is intended that the term apply to every member of that group. That is, the phrase "optionally substituted alkyl or aryl" is to be interpreted as "optionally substituted alkyl or optionally substituted aryl."

The terms "polymer," "copolymer," "polymerize," "copolymerize," and the like include not only polymers comprising two monomer residues and polymerization of two different monomers together, but also include (co)polymers comprising more than two monomer residues and polymerizing together more than two or more other monomers. For example, a polymer as disclosed herein includes a terpolymer, a tetrapolymer, polymers comprising more than four different monomers, as well as polymers comprising, consisting of, or consisting essentially of two different monomer residues. Additionally, a "polymer" as disclosed herein may also include a homopolymer, which is a polymer comprising a single type of monomer unit.

Unless specified differently, the polymers of the present disclosure may be linear, branched, crosslinked, structured, synthetic, semi-synthetic, natural, and/or functionally modified. A polymer of the present disclosure can be in the form of a solution, a dry powder, a liquid, or a dispersion, for example.

The compositions disclosed herein comprise a reaction product of thioglycolic acid (TGA) and a dicarbonyl compound. In some embodiments, the reaction product comprises a structure selected from Formula I

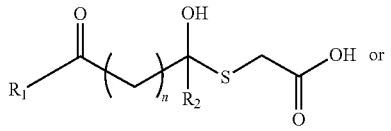

Formula II

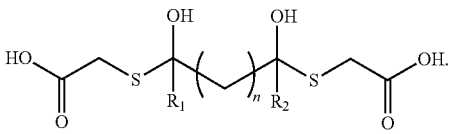

In Formulas I and II, $R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 100.

In some embodiments, n is an integer selected from 0 to about 50, such as 0 to about 40, 0 to about 30, 0 to about 20, or 0 to about 10. In some embodiments, n is an integer selected from 1 to about 50, such as 1 to about 40, 1 to about 30, 1 to about 20, or 1 to about 10.

In certain embodiments, $R_1$ is H. In some embodiments, $R_1$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_1$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_1$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_1$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

In certain embodiments, $R_2$ is H. In some embodiments, $R_2$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_2$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_2$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_2$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

The compositions disclosed herein may comprise, consist of, or consist essentially of a single compound or any number of compounds falling within the scope of Formula I, optionally combined with a solvent. Alternatively or additionally, the compositions disclosed herein may comprise, consist of, or consist essentially of a single compound or any number of compounds falling within the scope of Formula II, optionally combined with a solvent.

In certain embodiments, the compositions disclosed herein comprise one or more solvents. For example, a composition in accordance with the present disclosure may comprise a solvent selected from water, a $C_1$-$C_6$ alkanol, a $C_1$-$C_6$ alkoxyalkanol, an alcohol, a glycol ether, a hydrocarbon, a ketone, an ether, an alkylene glycol, an amide, a nitrile, a sulfoxide, an ester, and any combination thereof.

In some embodiments, the compositions of the present disclosure may be in the form of a liquid, a gel, or a mixture thereof.

In certain embodiments, the compositions disclosed herein comprise a pH from about 1 to about 11. In some embodiments, the pH of the composition may be from about 1 to about 10, from about 1 to about 9, from about 1 to about 8, from about 1 to about 7, from about 1 to about 6, or from about 1 to about 5.

The compositions of the present disclosure may include any amount of the reaction product(s). For example, the composition may comprise from about 0.5 wt. % to about 100 wt. % of the reaction product, such as from about 1 wt. % to about 100 wt. %, about 10 wt. % to about 100 wt. %, about 20 wt. % to about 100 wt. %, about 30 wt. % to about 100 wt. %, about 40 wt. % to about 100 wt. %, about 50 wt. % to about 100 wt. %, about 60 wt. % to about 100 wt. %, about 70 wt. % to about 100 wt. %, about 80 wt. % to about 100 wt. %, or about 90 wt. % to about 100 wt. % of the reaction product.

In some embodiments, the composition of the present disclosure is stored, such as in a storage container, before being applied as a corrosion inhibitor. TGA is known to degrade and release toxic hydrogen sulfide gas but the presently disclosed compositions have been engineered such that there is a lack of, or substantial reduction of, hydrogen sulfide gas present in the headspace of the storage container.

To form the compounds of Formulas I and II, one or more dicarbonyl compounds are reacted with TGA, which comprises the following structure:

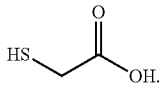

In some embodiments, the TGA and dicarbonyl compound are pre-mixed to form the reaction product(s) before the reaction product(s) is added to the medium in contact with the metal surface. For example, the reaction product may be formed outside of an aqueous system and may subsequently be added to the aqueous system. The inventors discovered certain advantages arising from pre-mixing the TGA and dicarbonyl compound as opposed to adding these components separately to the medium. For example, if the components are added separately, the dicarbonyl compound may react with other chemistries in the medium, such as amines, which may impair the intended function of the amine, reduce performance, and/or result in less reaction product.

In some embodiments, the dicarbonyl compound comprises the following structure:

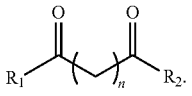

$R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 100, such as from 0 to about 50.

In certain embodiments, $R_1$ is H. In some embodiments, $R_1$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_1$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_1$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_1$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

In certain embodiments, $R_2$ is H. In some embodiments, $R_2$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_2$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_2$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_2$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

In some embodiments, n is an integer selected from 0 to about 50, such as 0 to about 40, 0 to about 30, 0 to about 20, or 0 to about 10. In some embodiments, n is an integer selected from 1 to about 50, such as 1 to about 40, 1 to about 30, 1 to about 20, or 1 to about 10.

In certain embodiments, the dicarbonyl compound is selected from glutaraldehyde, glyoxal, or a combination thereof.

In some embodiments, TGA may be reacted with one or more dicarbonyl compounds having the following structure:

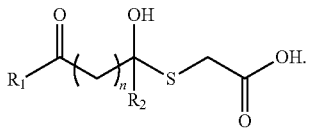

$R_1$ and $R_2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 100, such as from 0 to about 50.

In certain embodiments, $R_1$ is H. In some embodiments, $R_1$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_1$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_1$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_1$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

In certain embodiments, $R_2$ is H. In some embodiments, $R_2$ is selected from the group consisting of $C_1$ alkyl, $C_2$ alkyl, $C_3$ alkyl, $C_4$ alkyl, $C_5$ alkyl, $C_6$ alkyl, $C_7$ alkyl, $C_8$ alkyl, $C_9$ alkyl, or $C_{10}$ alkyl. In some embodiments, $R_2$ is selected from the group consisting of $C_1$ cyclic alkyl, $C_2$ cyclic alkyl, $C_3$ cyclic alkyl, $C_4$ cyclic alkyl, $C_5$ cyclic alkyl, $C_6$ cyclic alkyl, $C_7$ cyclic alkyl, $C_8$ cyclic alkyl, $C_9$ cyclic alkyl, or $C_{10}$ cyclic alkyl. In some embodiments, $R_2$ is selected from the group consisting of $C_1$ alkenyl, $C_2$ alkenyl, $C_3$ alkenyl, $C_4$ alkenyl, $C_5$ alkenyl, $C_6$ alkenyl, $C_7$ alkenyl, $C_8$ alkenyl, $C_9$ alkenyl, or $C_{10}$ alkenyl. In some embodiments, $R_2$ is selected from the group consisting of $C_1$ alkynyl, $C_2$ alkynyl, $C_3$ alkynyl, $C_4$ alkynyl, $C_5$ alkynyl, $C_6$ alkynyl, $C_7$ alkynyl, $C_8$ alkynyl, $C_9$ alkynyl, or $C_{10}$ alkynyl.

In some embodiments, n is an integer selected from 0 to about 50, such as 0 to about 40, 0 to about 30, 0 to about 20, or 0 to about 10. In some embodiments, n is an integer selected from 1 to about 50, such as 1 to about 40, 1 to about 30, 1 to about 20, or 1 to about 10.

In certain embodiments, the reaction product comprises

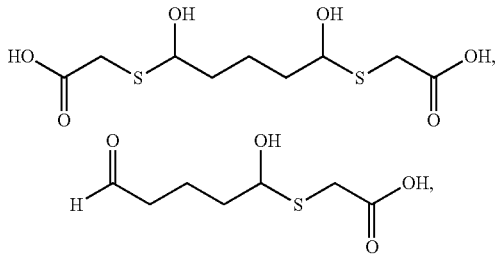

or a combination thereof.

The reactions may be carried out in a solvent or in the absence of a solvent. In some embodiments, TGA is reacted with the dicarbonyl compound at a molar ratio of about 6:1 TGA to dicarbonyl compound. In some embodiments, the molar ratio is about 0.5:1. In certain embodiments, the molar ratio ranges from about 6:1 to about 0.5:1 or from about 4:1 to about 1:1. In some embodiments, the molar ratio of TGA to dicarbonyl compound is about 2:1.

If insufficient dicarbonyl compound is added to the TGA, there will be insufficient reaction with TGA, resulting in excess TGA, which generates hydrogen sulfide in the headspace. Excess dicarbonyl compound, however, results in adding unnecessary cost to the corrosion inhibitor. Additionally, dicarbonyl compounds are known to react with some amines, which may impair the performance of these chemistries if such amines are present in the corrosion inhibitor composition.

The reaction mixture may comprise any solvent disclosed herein or the reaction may be carried out neat (in the absence of a solvent). If a solvent is included, it may comprise, for example, water and/or water miscible solvents, such as $C_1$-$C_6$ alkanols, alkoxyalkanols, glycols, glycol ethers, glycol esters, and mixtures of any solvents contemplated by the present disclosure.

In some embodiments, the reaction mixture is heated. For example, the reaction mixture may be heated to a temperature of about 60° C. to 150° C., such as from about 60° C. to 120° C. or about 60° C. to 90° C. In some embodiments, the reaction mixture is heated for a period of about 1 minute to about 12 hours, such as from about 10 minutes to about 10 hours or about 30 minutes to about 5 hours.

After the reaction is complete, the reaction product(s) may be purified or it may be added to a medium, such as an aqueous medium, and employed as a corrosion inhibitor without any purification.

The present disclosure also provides methods of inhibiting corrosion of a metal surface in contact with a medium. The methods comprise adding an effective amount of a composition to the medium, wherein the composition comprises, consists of, or consists essentially of the reaction product disclosed herein, optionally combined with a solvent. The composition may be added continuously, intermittently, automatically, and/or manually.

In some embodiments, the effective amount added to the medium is from about 1 ppm to about 10,000 ppm. For example, the effective amount may be from about 1 ppm to about 5,000 ppm, from about 1 ppm to about 4,000 ppm, from about 1 ppm to about 3,000 ppm, from about 1 ppm to about 2,000 ppm, from about 1 ppm to about 1,000 ppm, from about 1 ppm to about 500 ppm, from about 1 ppm to about 250 ppm, or from about 1 ppm to about 100 ppm.

In some embodiments, the medium is an aqueous medium, such as produced water, seawater, municipal water, "gray" water, brackish water, fresh water, recycled water, salt water, surface water, connate, groundwater, wastewater, or any combination of the foregoing. The aqueous medium may be a continuously flowing medium, such as produced water flowing from a subterranean reservoir and into or through a pipe or tank. The aqueous medium may also be, for example, wastewater isolated from a continuous manufacturing process flowing into a wastewater treatment apparatus. In other embodiments, the aqueous medium is a batch, or plug, substantially disposed in a batchwise or static state within a metal containment.

The presently disclosed compositions are useful for inhibiting corrosion of metal surfaces in contact with any type of corrodent in the medium, such as metal cations, metal complexes, metal chelates, organometallic complexes, aluminum ions, ammonium ions, barium ions, chromium ions, cobalt ions, cuprous ions, cupric ions, calcium ions, ferrous ions, ferric ions, hydrogen ions, magnesium ions, manganese ions, molybdenum ions, nickel ions, potassium ions, sodium ions, strontium ions, titanium ions, uranium ions, vanadium ions, zinc ions, bromide ions, carbonate ions, chlorate ions, chloride ions, chlorite ions, dithionate ions, fluoride ions, hypochlorite ions, iodide ions, nitrate ions, nitrite ions, oxide ions, perchlorate ions, peroxide ions, phosphate ions, phosphite ions, sulfate ions, sulfide ions, sulfite ions, hydrogen carbonate ions, hydrogen phosphate ions, hydrogen phosphite ions, hydrogen sulfate ions, hydrogen sulfite ions, an acid, such as carbonic acid, hydrochloric acid, nitric acid, sulfuric acid, nitrous acid, sulfurous acid, a peroxy acid, or phosphoric acid, ammonia, bromine, carbon dioxide, chlorine, chlorine dioxide, fluorine, hydrogen chloride, hydrogen sulfide, iodine, nitrogen dioxide, nitrogen monoxide, oxygen, ozone, sulfur dioxide, hydrogen peroxide, polysaccharides, metal oxides, sands, clays, silicon dioxide, titanium dioxide, muds, insoluble inorganic and/or organic particulates, an oxidizing agent, a chelating agent, an alcohol, and any combination of the foregoing.

In some embodiments, the medium is an aqueous medium with a pH of about 1 to about 14. For example, the aqueous medium may have a pH less than about 7 or greater than about 7. In some embodiments, the pH of the aqueous medium is between about 1 and about 6, about 2 and about 6, about 3 and about 6, about 4 and about 6, and about 5 and about 6. In some embodiments, the pH of the aqueous medium is between about 7 and about 14. For example, the pH may be about 7 to about 12, about 7 to about 10, or about 7 to about 8.

In some embodiments, the aqueous medium comprises from about 1 ppm to about 10,000 ppm, by weight or by volume, of the reaction product(s) disclosed herein. In some embodiments, the aqueous medium comprises from about 1 ppm to about 5,000 ppm, from about 1 ppm to about 4,000 ppm, from about 1 ppm to about 3,000 ppm, from about 1 ppm to about 2,000 ppm, from about 1 ppm to about 1,000 ppm, from about 1 ppm to about 500 ppm, from about 1 ppm to about 250 ppm, or from about 1 ppm to about 100 ppm of the reaction product(s) disclosed herein.

The presently disclosed compositions are useful for inhibiting corrosion of any metal surfaces. In some embodiments, the metal surface comprises steel, such as stainless steel or carbon steel. In some embodiments, the metal surface comprises iron, aluminum, zinc, chromium, manganese, nickel, tungsten, molybdenum, titanium, vanadium, cobalt, niobium, or copper. The metal surface may also comprise any combination of the foregoing metals and/or any one or more of boron, phosphorus, sulfur, silicon, oxygen, and nitrogen. In some embodiments, a pipe or a tank (e.g., railroad tank car or a tank truck/tanker) comprises the metal surface.

In some embodiments, the methods disclosed herein further comprise adding a component to the medium. The component may be added before, after, and/or with the composition. The component may be added continuously, automatically, intermittently, and/or manually. In some embodiments, the composition comprises the component. In some embodiments, the composition consists of or consists essentially of the reaction product, a solvent, and a component.

Illustrative, non-limiting examples of components include a fouling control agent, an additional corrosion inhibitor, a biocide, a preservative, an acid, a hydrogen sulfide scavenger, a surfactant, an asphaltene inhibitor, a paraffin inhibitor, a scale inhibitor, a gas hydrate inhibitor, a pH modifier, an emulsion breaker, a reverse emulsion breaker, a coagulant/flocculant agent, an emulsifier, a water clarifier, a dispersant, an antioxidant, a polymer degradation prevention agent, a permeability modifier, a foaming agent, an antifoaming agent, a $CO_2$ scavenger, an $O_2$ scavenger, a gelling agent, a lubricant, a friction reducing agent, a salt, and any combination thereof.

The additional corrosion inhibitor may comprise, for example, an imidazoline compound, a pyridinium compound, a quaternary ammonium compound, a phosphate ester, an amine, an amide, a carboxylic acid, a thiol, and any combination thereof.

The fouling control agent may comprise, for example, a quaternary compound.

Illustrative, non-limiting examples of biocides include chlorine, hypochlorite, $ClO_2$, bromine, ozone, hydrogen peroxide, peracetic acid, peroxycarboxylic acid, peroxycarboxylic acid composition, peroxysulphate, glutaraldehyde, dibromonitrilopropionamide, isothiazolone, terbutylazine, polymeric biguanide, methylene bisthiocyanate, tetrakis hydroxymethyl phosphonium sulphate, and any combination thereof.

The acid may comprise, for example, hydrochloric acid, hydrofluoric acid, citric acid, formic acid, acetic acid, or any combination thereof.

The hydrogen sulfide scavenger may comprise, for example, an oxidant, inorganic peroxide, chlorine dioxide, a $C_1$-$C_{10}$ aldehyde, formaldehyde, glyoxal, glutaraldehyde, acrolein, methacrolein, a triazine, or any combination thereof.

The surfactant may be non-ionic, cationic, anionic, amphoteric, or zwitterionic.

When the composition comprises a component (or combination of components), it generally comprises from about 0.1 wt. % to about 20 wt. % of the component. For example, the composition may comprise from about 0.1 wt. % to about 15 wt. %, from about 0.1 wt. % to about 10 wt. %, from about 0.1 wt. % to about 5 wt. %, from about 0.1 wt. % to about 1 wt. %, from about 1 wt. % to about 5 wt. %, or from about 1 wt. % to about 10 wt. % of the component.

The composition (and optional component if separate from the composition) may be added to the medium neat, dissolved in a solvent, partially dissolved in a solvent, and/or dispersed in a solvent. The addition may involve manual addition, automatic addition, dripping, pouring, spraying, pumping, injecting, or otherwise adding the composition and optional component to the medium and/or the metal surface. In some embodiments, the composition may be heated, such as from about 30° C. to 100° C., prior to addition. In some embodiments, the composition is added directly to the metal surface instead of or in addition to the medium.

In some embodiments, the medium and/or metal surface to be treated with the presently disclosed composition may be located in a cooling water system, a boiler water system, a petroleum well, a downhole formation, a geothermal well, a mineral washing process, a flotation and benefaction process, a papermaking process, a gas scrubber, an air washer, a continuous casting processes, an air conditioning and refrigeration process, a water reclamation process, a water purification process, a membrane filtration process, a clarifier, a municipal sewage treatment process, a municipal water treatment process, or a potable water system.

The foregoing may be better understood by reference to the following examples, which are intended for illustrative purposes and are not intended to limit the scope of the disclosure or its application in any way.

EXAMPLES

Appropriate amounts of TGA and glutaraldehyde were separately mixed together. The blends were then assessed for headspace hydrogen sulfide and compared to with TGA by itself after leaving for a week at elevated temperature (about 60° C.). Corrosion inhibitor tests were also carried out and performance assessed at the same levels of TGA.

Blend 1 included about 28 wt. % TGA and about 72 wt. % of a 50 wt. % glutaraldehyde composition (49.5 wt. % water, 0.5 wt. % methanol).

Blend 2 included about 5 wt. % TGA with about 95 wt. % methanol.

Blend 3 included about 10 wt. % TGA with about 90 wt. % methanol.

TABLE 1

| Sample | % TGA present | Exposure Temp. ° C. | Exposure Time (days) | $H_2S$ (ppm) |
|---|---|---|---|---|
| Blend 1 | 28 | 60 | 10 | Not detectable |
| Blend 2 | 5 | 60 | 8 | >560 |
| Blend 3 | 10 | 60 | 8 | >560 |

The TGA and glutaraldehyde blend had non-detectable hydrogen sulfide in the headspace while the TGA by itself had large levels of hydrogen sulfide detected. As seen below, however, the performance of the TGA and glutaraldehyde blend was still comparable to (if not slightly better than) the TGA by itself at the same TGA levels.

Additional hydrogen sulfide headspace testing was carried out. The samples and results are shown in Table 2.

TABLE 2

| Blend | 29A | 29B | 29C | 29D | 29E | 29F | 29G | 29H | 29I | 29S |
|---|---|---|---|---|---|---|---|---|---|---|
| TGA % | 100 | 28 | 33 | 40 | 50 | 67 | 80 | 90 | 95 | 0 |
| (50% glutaraldehyde), % | 0 | 72 | 67 | 60 | 50 | 33 | 20 | 10 | 5 | 100 |
| Actual glutaraldehyde amount | 0 | 36 | 33 | 30 | 25 | 17 | 10 | 5 | 2.5 | 100 |
| Total TGA + glutaraldehyde (no water) | 100 | 64 | 67 | 70 | 75 | 83 | 90 | 95 | 97.5 | 50 |
| % of TGA out of TGA + Glutaraldehyde only | 100 | 43 | 50 | 57 | 67 | 80 | 89 | 95 | 97 | 0 |
| % of Glutaraldehyde out of TGA + Glutaraldehyde only | 0 | 56.5 | 50 | 43 | 33 | 20 | 11 | 5 | 2.5 | 100 |
| Ratio TGA:Glutaraldehyde | N/A | 0.77 | 1 | 1 | 2 | 4 | 8 | 18 | 38 | N/A |
| H2S (ppm) after 7 days at 60° C. | >960 | ND | ND | ND | ND | 100 | >960 | >960 | >960 | ND |

ND = non-detectable

Corrosion bubble cell tests were performed using the following conditions to evaluate the corrosion inhibition performance of Blend 1 on a carbon steel electrode. The corrosion rate was assessed electrochemically using linear polarization resistance (LPR) methodology. Tests were carried out at atmospheric pressure at about 80° C. using $CO_2$ saturated fluids with 3% NaCl brine (80%) and LVT-200 hydrocarbon (20%) with a continuous $CO_2$ sparge. The results are shown below in Table 3.

TABLE 3

| Sample | Chemistry | TGA activity (%) | Dosage (ppm - based on total fluids) | TGA active (ppm - based on total fluids) | Corrosion Rate after 15 hours of injection (mpy) | % Protection |
|---|---|---|---|---|---|---|
| Blank | N/A | N/A | N/A | N/A | 441 | N/A |
| Sample | TGA | 20 | 25 | 5 | 121 | 73 |
| Blend 1 | TGA + glutaraldehyde | 28 | 18 | 5 | 99 | 77 |

It can be seen that Blend 1 unexpectedly outperformed the sample containing only TGA in terms of % protection provided.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a reaction product" is intended to include "at least one reaction product" or "one or more reaction products."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Any composition disclosed herein may comprise, consist of, or consist essentially of any element, component and/or ingredient disclosed herein or any combination of two or more of the elements, components or ingredients disclosed herein.

Any method disclosed herein may comprise, consist of, or consist essentially of any method step disclosed herein or any combination of two or more of the method steps disclosed herein.

The transitional phrase "comprising," which is synonymous with "including," "containing," or "characterized by," is inclusive or open-ended and does not exclude additional, un-recited elements, components, ingredients and/or method steps.

The transitional phrase "consisting of" excludes any element, component, ingredient, and/or method step not specified in the claim.

The transitional phrase "consisting essentially of" limits the scope of a claim to the specified elements, components, ingredients and/or steps, as well as those that do not materially affect the basic and novel characteristic(s) of the claimed invention.

Unless specified otherwise, all molecular weights referred to herein are weight average molecular weights and all viscosities were measured at 25° C. with neat (not diluted) polymers.

As used herein, the term "about" refers to the cited value being within the errors arising from the standard deviation found in their respective testing measurements, and if those errors cannot be determined, then "about" may refer to, for example, within 5%, 4%, 3%, 2%, or 1% of the cited value.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of inhibiting corrosion of a metal surface in contact with a medium, comprising:

adding about 1 ppm to about 50,000 ppm of a composition to the medium, wherein the composition comprises a reaction product of thioglycolic acid and a dicarbonyl compound, wherein the reaction product comprises a structure selected from Formula I

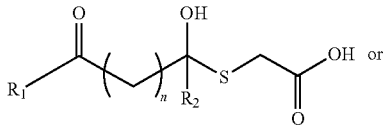

Formula II

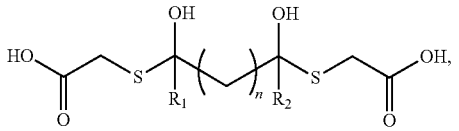

wherein $R^1$ and $R^2$ are independently selected from the group consisting of H, a $C_1$-$C_{30}$ alkyl, a $C_1$-$C_{30}$ cyclic alkyl, a $C_1$-$C_{30}$ alkenyl, and a $C_1$-$C_{30}$ alkynyl group, and n is an integer selected from 0 to about 50.

2. The method of claim 1, wherein the medium comprises a corrodent selected from the group consisting of hydrogen sulfide, carbon dioxide, oxygen, sodium chloride, calcium chloride, sulfur dioxide, and any combination thereof.

3. The method of claim 1, wherein the medium comprises produced water, fresh water, recycled water, salt water, surface water, or any mixture thereof.

4. The method of claim 1, wherein the metal surface comprises carbon steel.

5. The method of claim 1, further comprising adding to the medium a component selected from the group consisting of a fouling control agent, an additional corrosion inhibitor, a biocide, a preservative, an acid, a hydrogen sulfide scavenger, a surfactant, an asphaltene inhibitor, a paraffin inhibitor, a scale inhibitor, a gas hydrate inhibitor, a pH modifier, an emulsion breaker, a reverse emulsion breaker, a coagulant/flocculant agent, an emulsifier, a water clarifier, a dispersant, an antioxidant, a polymer degradation prevention agent, a permeability modifier, a foaming agent, an anti-foaming agent, a $CO_2$ scavenger, an $O_2$ scavenger, a gelling agent, a lubricant, a friction reducing agent, a salt, and any combination thereof.

6. The method of claim 5, wherein the composition comprises from about 0.1 wt. % to about 20 wt. % of the component.

7. The method of claim 1, wherein the medium comprises from about 1 ppm to about 1,000 ppm of the reaction product.

8. The method of claim 5, wherein the component is added to the medium before, after, and/or simultaneously with the composition.

* * * * *